US005653334A

United States Patent [19]

Marco

[11] Patent Number: 5,653,334

[45] Date of Patent: Aug. 5, 1997

[54] TEAR STRIP FOR SIDE HANDLE CARRIER

[75] Inventor: Leslie S. Marco, Bloomingdale, Ill.

[73] Assignee: Illinois Tool Works Inc., Glenview, Ill.

[21] Appl. No.: 522,866

[22] Filed: Sep. 1, 1995

[51] Int. Cl.[6] ..... B65D 75/00; B66C 1/10

[52] U.S. Cl. ..... 206/150; 206/151; 294/87.2

[58] Field of Search ..... 206/150, 151, 206/427; 294/87.2

[56] References Cited

U.S. PATENT DOCUMENTS

| | | | |
|---|---|---|---|
| 3,038,602 | 6/1962 | Rapata . | |
| 3,204,386 | 9/1965 | Creed et al. . | |
| 3,348,674 | 10/1967 | Poupitch | 206/151 |
| 4,250,682 | 2/1981 | Braun . | |
| 5,018,620 | 5/1991 | Marco et al. | 206/150 |
| 5,072,829 | 12/1991 | Marco et al. | 206/150 X |
| 5,174,441 | 12/1992 | Marco . | |
| 5,544,749 | 8/1996 | Watts | 206/150 X |

*Primary Examiner*—Bryon P. Gehman
*Attorney, Agent, or Firm*—Trexler, Bushnell, Giangiorgi & Blackstone, Ltd.

[57] ABSTRACT

A novel for carrying a plurality of containers, such as bottles, cans and the like, includes novel tear strips which can be separated from the carrier so that the containers held by the carrier can be easily removed from the carrier. The carrier includes container engaging portions, each of which includes bands which define apertures therein for engaging the side walls of the containers to hold the containers therein to form a package. Each band has an inner margin portion, an outer margin portion and side margin portions. Each tear strip is positioned on the outer margin portions of the bands. The strip is separated from the remainder of the carrier by a perforation line, which is formed from a series of spaced dots, along which the strip can be torn. In one embodiment, a handle is attached to the tear strip for carrying the carrier and associated containers on their sides. The dots in the perforation line which are adjacent to the juncture where the handle connects with the tear strip are spaced further apart than the dots in the remainder of the line. A pair of spaced slits or a single slit are provided at the end of the line to direct the tearing forces inwardly into the last aperture to free the container held therewithin.

19 Claims, 2 Drawing Sheets

TEAR STRIP FOR SIDE HANDLE CARRIER

BACKGROUND OF THE INVENTION

This invention is generally directed to a novel carrier which is used to secure containers together to form a package. More particularly, the invention contemplates a carrier which secures containers, such as bottles or the like, together into a package and from which the containers are easily removed.

Currently, several types of carriers can be found in the art for securing containers together into a package. Some of these carrier provide quick release means for allowing a consumer to quickly and easily release the containers from the carrier.

One such carrier can be found in U.S. Pat. No. 3,038,602 which discloses a container carrier that holds six cans in a package array. The carrier is positioned near the top of each can. A zipper strip is provided on the carrier and is positioned between the rows of cans. A consumer releases the cans from the carrier by tearing the zipper strip. When the zipper strip is torn, the carrier creates two sets of packages, each consisting of three cans.

One problem which arises with this type of quick release carrier is that when the zipper strip is torn, two separate packages are formed which may be undesirable for handling the cans.

Another such carrier can be found in U.S. Pat. No. 5,174,441 which discloses a tear-open container carrier that holds a plurality of cans in a package. Each can is held within a container encircling band. Tear strips are provided on the carrier exterior to the container encircling bands. A consumer releases the cans from the carrier by tearing the tear strips. The removal of the strip ruptures each individual band.

One problem which arises with this type of quick release carrier is that when the tear strips are torn, each band in the carrier is ruptured which can lead to the cans being uncontrollably dislodged from the carrier.

The present invention presents a quick release carrier which overcomes or minimizes the problems presented by the prior art and presents several other novel advantages and features.

OBJECTS AND SUMMARY OF THE INVENTION

A general object of the present invention is to provide a novel plastic carrier for carrying a plurality of containers, such as bottles, cans or the like, which includes novel tear strips which allow a consumer to easily and quickly remove containers from the carrier.

An object of the present invention is to provide a carrier which has novel tear strips which can be detached from the remainder of the carrier while maintaining the containers in a package to prevent the containers from becoming uncontrollably dislodged from the carrier.

A further object of the present invention is to provide a carrier which is sturdy while allowing containers to be easily and quickly released from the carrier.

Yet another object of the present invention is to provide a novel plastic carrier for carrying a plurality of containers, such as bottles, cans or the like, which includes novel tear strips which allow a consumer to easily and quickly remove containers from the carrier, wherein the last container is released from the carrier when the tear strip is torn.

Briefly, and in accordance with the foregoing, the present invention discloses a novel carrier for carrying a plurality of containers, such as bottles, cans and the like, which includes novel tear strips which can be separated from the carrier so that the containers held by the carrier can thereafter be easily and quickly removed from the carrier. The carrier includes container engaging portions, each of which includes annular rings or bands which define apertures therein for engaging the side walls of the containers to hold the containers therein to form a package. The outer margins of the apertures are contoured.

Each ring or band has an inner margin portion, an outer margin portion and side margin portions. The inner margin portions of adjacent bands are joined together and side margin portions of adjacent bands are joined together. Each tear strip is positioned on the outer margin portions of the bands. The strip is separated from the remainder of the carrier by a perforation line along which the strip can be torn. Once the strip is torn, a narrow, continuous web remains along the length of the carrier to maintain the containers in a package array. The web is selectively ruptured and may be ruptured by leveraging a container against an adjacent container.

The perforation line is formed from a series of spaced dots, dashes or the like. A continuous portion of the carrier is provided between each dot or dash. Each tear strip has a width which is greater than the distance between two adjacent dots or dashes.

In first and second embodiments of the carrier which shows the prior art, each perforation line starts at an end of the carrier and ends in a region that is spaced inwardly from the side margin of the last aperture on the opposite side of the carrier. The perforation line ends in a region within the perimeter of the carrier such that when the strip is separated from the remainder of the carrier, the strip remains attached to the carrier at an end of the strip.

In a third embodiment of the carrier, the carrier includes container engaging portions which are planar and have a handle attached to one side of one of the container engaging portions. A perforation line is provided along the outer margin of each container engaging portion. Therefore, the perforation line on the side of the carrier which has the handle provided thereon is between the handle and the apertures. The individual dots, dashes or the like in the region where the handle is connected to the outer margin of the container engaging portion are spaced further apart than the dots, dashes or the like along the remainder of the perforation line.

Each perforation line starts at an end of the carrier and ends in a region proximate to the last aperture on the opposite side of the carrier. The carrier may have a pair of spaced slits provided at the end of the perforation line between the perforation line and the aperture which will direct tearing forces when the tear strip is torn into the last aperture in the carrier to release the container therein. The spaced slits are parallel to the perforation line. Alternatively, the carrier may have a single, angled slit provided at the end of the perforation line between the perforation line and the aperture which will direct tearing forces when the tear strip is torn into the last aperture in the carrier to release the container therein. When the strip is separated from the remainder of the carrier, the strip remains attached to the carrier.

The start of the perforation line may be aligned with the remainder of the perforation line, or alternatively, the start of the perforation line may be angled approximately five degrees relative to the remainder of the perforation line. The material proximate to the aperture near the start of the perforation line is increased to prevent tearing forces from being directed into the first aperture. This defines a point which is closest to the perforation line. The angled perforation line meets the remainder of the perforation line prior to the point of the aperture closest to the perforation line.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENT

Figure 1:
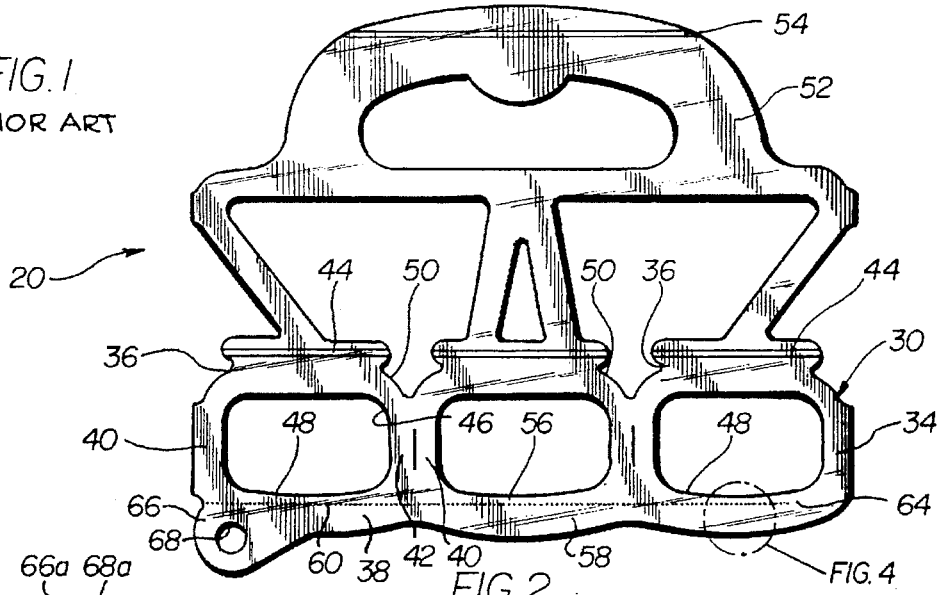
FIG. 1 PRIOR ART
FIG. 1 is a side elevational view of a carrier which incorporates the features of a first embodiment of the invention which shows the prior art.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

Figure 2:
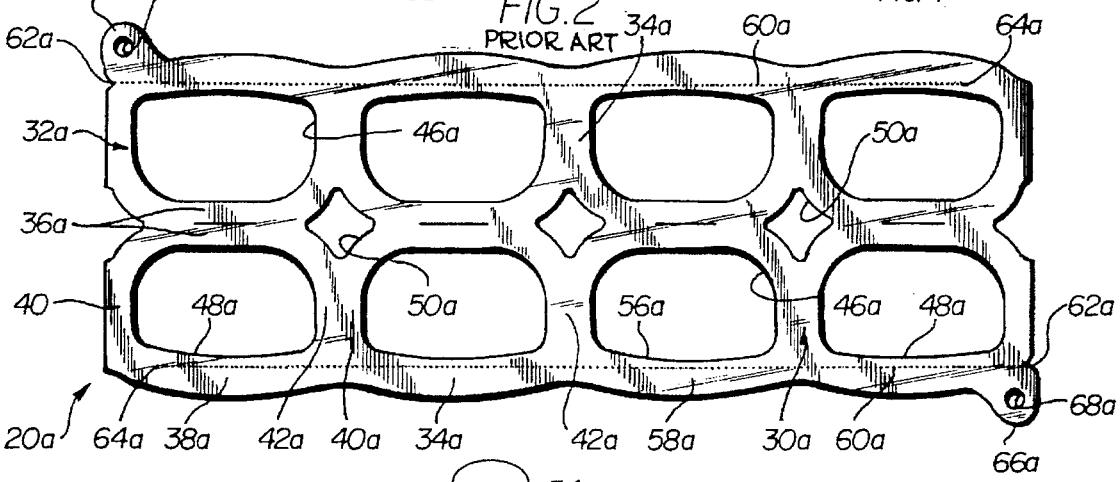
FIG. 2 PRIOR ART
FIG. 2 is a top elevational view of a carrier which incorporates the features of a second embodiment of the invention which shows the prior art.
Figure 3:
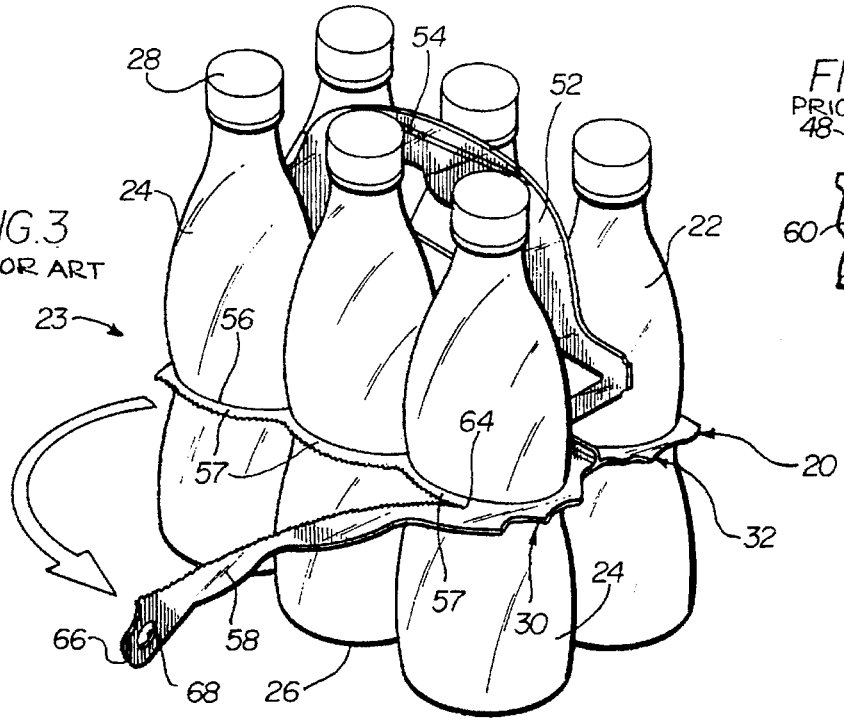
FIG. 3 PRIOR ART
FIG. 3 is a perspective view of the carrier of FIG. 1 shown surrounding a plurality of containers to form a package.
Figure 5:
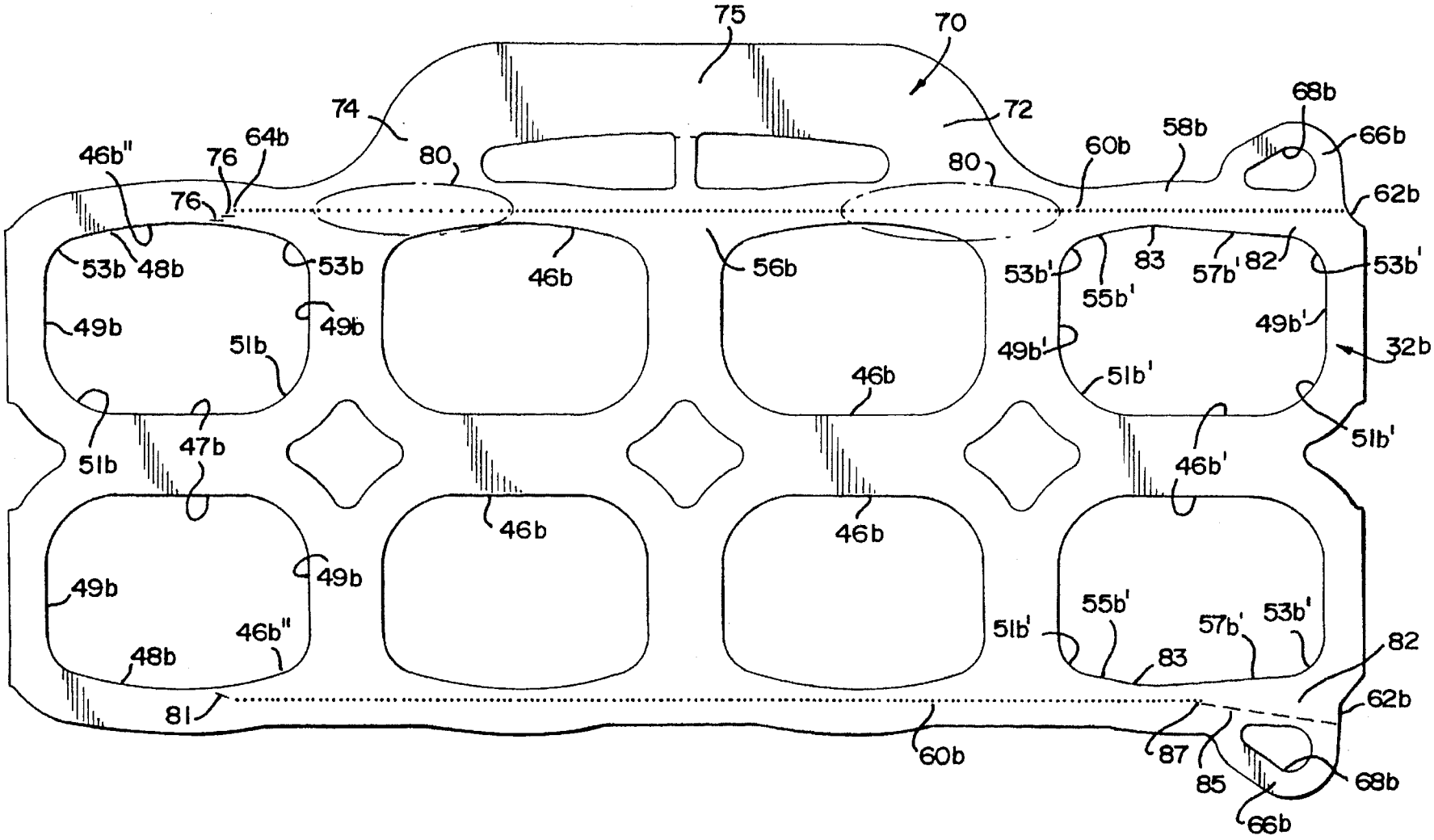
FIG. 5 is a top elevational view of a third embodiment of the carrier which incorporates several features of the invention.

As shown in the drawings, a multi-packaging device or carrier device 20, 20*a*, 20*b*, constructed according to the teachings of the present invention, is shown holding a plurality of containers 22. A first embodiment of the carrier 20 which shows the prior art is shown in FIGS. 1 and 3. A second embodiment of the carrier 20*a* which shows the prior art is shown in FIG. 2 and a third embodiment of the carrier 20*a* is shown in FIG. 5. Like elements in each embodiment are denoted by like reference numerals with the like elements of the second embodiment having the suffix "a" thereafter and with the like elements of the third embodiment having the suffix "b" thereafter.

As shown in FIG. 3, the carrier device 20, constructed in accordance with the teachings of the present invention, is used to carry six bottles 22 to form a package 23. Of course, the embodiments of the carrier device 20*a*, 20*b* shown in FIGS. 2 and 3, respectively, are employed in a like manner to form a package. Each bottle 22 includes a side wall 24, a bottom wall 26 and a top or cap 28. It is to be understood that other types of containers can be carried by the carrier 20, 20*a*, 20*b*, such as cans and the like.

The general structure of the first embodiment of the multi-package device or carrier device 20 shown in FIG. 1 and the method for forming the same is disclosed in U.S. patent application Ser. No. 08/230,308 entitled "Container Carrier" and owned by the assignee herein and which disclosure is incorporated herein by reference. The general structure of the second and third embodiments of the multi-package device or carrier 20*a*, 20*b*, shown in FIGS. 2 and 3 respectively, is a carrier 20*a*, 20*b* formed from a substantially planar blank or sheet by suitable known means.

Each carrier 20, 20*a*, 20*b* is made of a suitable flexible, resilient, stretchable material, such as plastic. Preferably, the carrier 20, 20*a*, 20*b* is made of a low density polyethylene so that the carrier 20, 20*a*, 20*b* can be stretched over the containers 22 and conform to the side walls 24 of the containers 22. The carrier 20, 20*a*, 20*b* may be applied to the containers 22 by known means, for example, by the machines disclosed in U.S. Pat. No. 4,250,682 to Braun or U.S. Pat. No. 3,204,386 to Creed et al.

When the containers 22 are secured in a package arrangement by the carrier 20, 20*a*, 20*b*, the containers 22 are aligned in an array so to form two rows. As shown in the carrier 20 in the first embodiment, each row has three bottles. The carrier 20*a*, 20*b* carry four bottles. It is to be understood that the carrier 20, 20*a*, 20*b* operates equally well with any number of containers.

Directing attention to the general structure of the first embodiment of the carrier 20 shown in FIG. 1, the carrier 20 includes container engaging portions 30, 32, each formed from a plurality of annular rings or bands 34. Each band 34 has an inner margin 36, an outer margin 38 and side margins 40, 42 which connect the inner margin 36 of each band 34 to the outer margin 38 of the same band 34. The side margins of adjacent bands 34 are integrally joined together so that the outer margins 38 of the bands 34 are continuous and uninterrupted along the length of the carrier 20.

The bands 34 are connected or joined together by a seam or a joined portion 44, as described herein, along the inner margins 36 of each band 34. The annular bands 34 define a plurality of shaped apertures 46 for securely holding the containers 22 therein as shown in FIG. 3. The outer margin 48 of each aperture 46 is slightly contoured for reasons described herein.

The container engaging portions 30, 32 freely extend from the joined portion 44. The joined portion 44 projects generally perpendicular to the plane of the container engaging portions 30, 32 when the carrier 20 is assembled with containers 22.

The joined portion 44 is formed by extruding a strip or layer of resilient, stretchable material, such as plastic, preferably low density polyethylene material, between the inner margins 36 of each annular band 34 and thereafter sufficiently melting and merging the inner margins 36 of the container engaging portions 22, 24 and the layer of extruded plastic together by known means, preferably by heat sealing and fusing the layers together, to form a strong, integral bond. The joined portion 44 is interrupted along its length by cutouts 50 which form apertures between the container engaging portions 30, 32.

Preferably, the carrier 20 is formed by joining two separate sheets of plastic material together at the joined portion 44. However, it is within the scope of the invention that a single sheet of plastic material may be used to form the carrier 20 by folding the sheet in half and applying a layer of plastic or otherwise fusing the sheets together to form the joined portion 44.

The carrier 20 includes a handle portion 52 which extends upwardly from the joined portion 44 of the carrier 20. The handle portion 52 includes two sides portions which are formed from the two sheets that are used to form the carrier 20. A bond 54, formed by heat sealing or by extruding a layer of plastic material between the side portion, is provided along an upper portion of the handle portion 52 to prevent the side portions of the handle portion 52 from separating thereby making the handle portion 52 easy to grasp by a consumer. Alternatively, the carrier device 20 can be constructed without a handle portion.

Now directing attention to the general structure of the second embodiment of the carrier 20*a* shown in FIG. 2, the carrier 20*a* is formed from a substantially planar blank or sheet having container engaging portions 30*a*, 32*a*, each formed from a plurality of annular rings or bands 34*a*. Each band 34*a* has an inner margin 36*a*, an outer margin 38*a* and side margins 40*a*, 42*a* which connect the inner margin 36*a* of each band 34*a* to the outer margin 38*a* of the same band 34*a*. The inner margins of adjacent bands 34*a* are integrally joined together. The side margins of adjacent bands 34*a* are integrally joined together so that the outer margins 38*a* of the bands 34*a* are continuous and uninterrupted along the length of the carrier 20*a*.

The annular bands 34*a* define a plurality of shaped apertures 46*a* for securely holding containers therein. The outer margin 48*a* of each aperture 46*a* is slightly contoured for reasons described herein. The integrally joined inner margins 36*a* are interrupted by cutouts 50*a* which form apertures between the container engaging portions 30*a*, 32*a*. A consumer can easily grasp the package by inserting his or her fingers into the apertures 50*a*.

Now directing attention to the specifics of the features of the present invention, each carrier device 20, 20*a* includes novel tear strips 58, 58*a*. For clarity in the description of the tear strips 58, 58*a*, the tear strips of the present invention are described in reference to the embodiment of the multipackaging device or carrier device 20 shown in FIG. 1. The differences between the tear strips 58 of the first embodiment and the tear strips 58*a* of the second embodiment are noted herein.

The continuous outer margins 38 of the bands 34 on each side of the carrier device 20 are separated into a first portion 56 and a second portion 58 by a fine, linear perforation line 60 for reasons described herein. The second portion 58 forms a tear strip on each side of the rows of containers 22 along the continuous outer margins 48 of the bands 34. Each tear strip 58 is formed from a substantial portion of the continuous outer margins 48 of the bands 34. The strips 58, once separated from the remainder of the carrier 20, allow the containers 22 to be easily and quickly released from the carrier 20.

Figure 4:
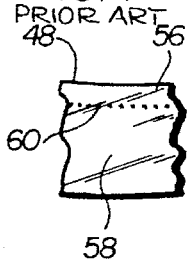
FIG. 4 PRIOR ART
FIG. 4 is an enlarged view of a portion of the carrier shown as indicated in FIG. 1.

The perforation line 60 which separates the tear strip or second portion 58 from the first portion 56 may be formed from a series of spaced dots, as shown in FIG. 4, or, alternatively, a series of spaced short lines. Each dot in the perforation line 60 is separated from each other by a continuous, uninterrupted portion of the carrier 20. The perforation lines 60 do not significantly reduce package integrity while facilitating tearing and removal of the tear strips 58 on each side of the carrier device 20. It is envisioned that an extruded bead of material could be used instead of the perforation line. The perforation line 60 is formed by suitable known means.

Each perforation line 60 starts at an end 62 of the carrier device 20 and preferably ends at point 64 which is within the perimeter of the carrier device 20 so that the strip 58 is integrally joined with the remaining portion of the carrier device 58 at point 64. The tear strips 58 used in the first embodiment of the carrier device 20, as shown in FIGS. 1 and 3, both start at the same end of the carrier device 20. The tear strips 58*a* used in the second embodiment of the carrier device 20*a*, as shown in FIG. 2, start at opposite ends of the carrier device 20*a*. While these configurations are shown in the drawings, the first embodiment of the carrier device 20 may have the perforation lines 60 starting at opposite ends and the second embodiment of the carrier device 20*a* may have the perforation lines 60*a* starting at the same end.

When each strip 58 is torn along its perforation line 60, the strip 58 remains attached to the carrier device 20 at point 64 and does not separate into a distinct, discardable device from the remainder of the carrier device 20. Each perforation line 60 also ends at point 64 which is spaced inwardly from the end margin of the last aperture on each side of the carrier device 20 for reasons described herein.

The perforation lines 60 allow a consumer to tear the tear strips 58 to separate the strips 58 from its associated first portion 56. Once each strip 58 is separated from its associated first portion 56, as shown in FIG. 3, a very narrow, continuous web of material, which is formed from the first portion 56, remains and is not torn or ruptured by the tearing of the strip 58. The containers 22 are retained in the package array by the narrow web 56 so as to not separate from each other. The narrow, continuous web 56 prevents the containers 22 from becoming dislodged uncontrollably when the consumer wants to open the package 23. The tearing action of the strip 58 from the remaining portion of the carrier device 20 may form a jagged edge along the length of the web 56. Preferably, as shown in FIG. 4, the width of the first portion 56, which later forms the narrow web after the tear strip 58 is torn, is greater than the distance between two adjacent dots or lines in the perforation line 60, so that the strip 58 may be removed with a minimal chance of the forces of removing the strip 58 being directed into the apertures 46 of the carrier device 20 prematurely.

To release the containers 22 from the carrier device 20, the narrow web 56 is selectively ruptured. Since the carrier device 20 is positioned along the side walls 24 of each of the bottles 22, the web 56 may be selectively and easily ruptured through a leveraging of the bottles 22 against adjacent bottles 22 to break the remaining narrow web 56 which holds the bottles 22 together in the package array.

Since the outer margins 48 of the apertures 36 in the carrier device 20 are slightly contoured and each tear strip 58 is linear, this creates a region 57 of specific reduced width of the remaining web 56, and therefore a stress concentration and weakness to facilitate the easy rupturing of the web 56 and removal of the containers 22 thereafter. Furthermore, since each perforation line 60 ends at point 64 which is spaced inwardly from the end margin of the last aperture 46, depending on the amount of force used to tear the strip 58, the final forces of the tearing of the strip 58 may be directed inwardly into the aperture 46 which releases the container 22 in that aperture 46 while retaining the containers in all other apertures.

Attention is now directed to the third embodiment of the carrier 20*b* shown in FIG. 5. The structure of the third embodiment of the carrier 20*b* is similar in form to that of the second embodiment of the carrier 20*a* and, as such, only the differences between the second embodiment of the carrier 20*a* and the third embodiment of the carrier 20*b* are described herein.

A handle portion 70 is integrally formed along the outer margin 38*b* of one of the container engaging portions, shown as container engaging portion 32*b*, and is, in effect, part of the tear strip 58*b*. The handle portion 70 has connecting portions 72, 74 which are integrally formed with the outermost extent of the tear strip 58*b* and a gripping portion 75 which is between the connecting portions 72, 74 and integrally connects the portions 72, 74 together. An aperture 77 is formed through the handle portion 70. To carry the package, a consumer places his or her fingers through the aperture 77 and grasps the middle gripping portion 75. When the package is carried by a consumer, the containers are on their sides.

The perforation line **60*b* which separates the tear strip or second portion 58*b* and the handle portion 70 from the first portion 56*b* may be formed from a series of individual dots which are spaced apart from each other or, alternatively, a series of spaced, individual short lines or slits. Each dot or slit in the perforation line 60*b* is separated from each other by a continuous, uninterrupted portion of the carrier 20*b***.

Each perforation line **60*b* starts at an end 62*b* of the carrier device 20*b* and ends at point 64*b*. Point 64*b* is within the perimeter of the carrier device 20*b* and is proximate to the inner edge of the last aperture 46*b*" on the side of the carrier 20*b* which is opposite to the side which the perforation line 60*b* starts. As shown, the perforation line 60*b* extends approximately one-fourth of the way across the width of the aperture 64*b*". It is to be understood that the perforation line 60*b* may end at a point which is further than that shown so long as the perforation line 60*b* ends within the perimeter of the carrier device 20*b***.

As shown on one side of the carrier **20*b*, a pair of slits 76 are provided between the end 64*b* of the perforation line 60*b* and the last aperture 64*b*" so that when the strip 58*b* is torn, the tearing forces are directed inwardly into the last aperture 64*b*" to free the container held therewithin. The slits 76 are parallel to the perforation line 60*b* and staggered apart from each other. The slits 76 are spaced from the end of the perforation line 60*b*, from each other, and from the aperture 46*b*" by a continuous portion of the carrier 20*b*. More than two slits may be provided. The slits 76** are formed by suitable means.

Alternatively, as shown on the other side of the carrier **20*b*, a single slit 81 is provided between the end 64*b* of the perforation line 60*b* and the last aperture 64*b*" so that when the strip 58*b* is torn, the tearing forces are directed inwardly into the last aperture 64*b*" to free the container held therewithin. The slit 81 is slightly angled relative to the perforation line 60*b* and is spaced from the end of the perforation line 60*b* and from the aperture 46*b*" by a continuous portion of the carrier 20*b*. The slit 81 is formed by suitable means. While the two slits 76 are shown on one side of the carrier 20*b* and the slit 81 is illustrated on the other side of the carrier 20*b*, it is to be understood that the two slits 76 may be provided on both sides of the carrier 20*b* or that the single, angled slit 81 may be provided on both sides of the carrier 20*b***.

As shown in FIG. 5, the tear strips **58*b* on each side of the carrier 20*b*, both start at the same end of the carrier device 20. While this configuration is shown in the drawings, the carrier device 20*b* may have the perforation lines 60*b* starting at opposite ends like that of the second embodiment of the carrier device 20*a***.

The width of the first portion **56*b*, which later forms the narrow web after the tear strip 58*b* is torn, is greater than the distance between any two adjacent dots or lines in the perforation line 60*b*. The dots, dashes or the like in the perforation line 60*b* in this embodiment of the carrier 20*b* are not equally spaced along the entire length of the perforation line 60*b*. As shown in FIG. 5, the spacing between the dots, dashes or the like in the perforation line 60*b* in the region 80 (shown by an oval in the drawing) which is at the base of each of the connecting portions 72, 74, are spaced further apart than the other dots, dashes or the like along the remainder of the perforation line 60*b*. The remainder of the dots, dashes or the like (outside of regions 80) are densely spaced along the perforation line 60*b*. The dots, dashes or the like in the perforation line 60*b* in the region 80 are spaced further apart than the other dots, dashes or the like along the remainder of the perforation line 60*b* to provide structural integrity at the point where the handle portion 70 and the tear strip 58*b* connect with the first portion 56*b*. Thus, the perforation line 60*b* is able to withstand the stress that is created by the consumer pulling the handle portion 70 upwardly with respect to the remainder of the package when the package is being carried. This prevents or at least minimizes the possibility of the perforation line 60*b* prematurely rupturing in regions 80 due to these stresses. The dots, dashes or the like in region 80, however, are not spaced so far apart so that the perforation line 60*b* cannot be torn, but the region 80 is more difficult to tear than the remainder of the perforation line 60*b*. In addition, the dots, dashes or the like in region 80 are spaced apart from each other a distance which is less than the width of the first portion 56*b***.

The shape of the apertures **46*b*, 46*b*" away from the start of the perforation line 60*b* are similar in shape to that shown in the second embodiment. Specifically, each aperture 46*b* has an inner margin 47*b*, an outer margin 48*b* and side margins 49*b*. The inner margin 47*b* and side margins 49*b* are substantially linear. The inner margin 47*b* and each side margin 49*b* are connected by rounded corner margins 51*b*. The outer margin 48*b* of each aperture 46*b* is slightly contoured and is arc-shaped. The contoured, rounded outer margin 48*b* and each side margin 49*b* are connected by rounded corner margins 53*b*. The outer margin 48*b* is concave with respect to the remainder of the aperture 46*b* such that the distance between the outer margin 48*b* of the aperture 46*b* and the perforation line 60*b*** is the smallest in the center of the arc.

The shape of the aperture **46*b*' closest to the start of the perforation line 60*b* in this embodiment of the carrier 20*b* has been modified from the remainder of the apertures 46*b*, 46*b*" in the carrier device 20*b*' Specifically, on the side of aperture 46*b*' closest to the start of the perforation line 60*b*, the width 82 between the outer margin 48*b*' of the first aperture 46*b*' and the perforation line 60*b* has been widened and tapered so as to increase the amount of material between the aperture 46*b*' and the start of perforation line 60*b*. Margins 47*b*', 49*b*', 51*b*' and 53*b*' are identical in shape to the like margins 47*b*, 49*b*, 51*b* and 53*b*, respectively, of the other apertures 46*b*, 46*b*" in the carrier device 20*b*. Outer margin 48*b*' has been modified to include an arc-shaped margin portion 55*b*' and a linear margin portion 57*b*'. The arc-shaped margin portion 55*b*' has a first end which connects to the rounded corner margin 53*b*' which is farthest away from the start of the perforation line 60*b* and a second end which connects to the end of the linear margin portion 57*b*' at point 83 which is preferably located more than half way across the aperture 46*b*'. Point 83 also defines the point of minimum distance of the outer margin of the aperture 46*b*' from the perforation line 60*b*. The opposite end of the linear margin portion 57*b*' connects to the rounded corner margin 53*b*' which is closest to the start of the perforation line 60*b*. The arc-shaped margin portion 55*b*' of the outer margin 48*b*' is generally concave such that the distance between the arc-shaped margin portion 55*b*' of the outer margin 48*b*' of the aperture 46*b*' and the perforation line 60*b* lessens from the first end of the arc-shaped margin portion 55*b*' to the second end of the arc-shaped margin portion 55*b*'. Therefore, the distance between the linear margin portion 57*b*' of the outer margin 48*b*' of the aperture 46*b*' and the perforation line 60b increases from the end of the linear margin portion 57b' which is connected to the arc-shaped margin portion 55b' to the opposite end of the linear margin portion 57b' which is connected to the corner margin 53b' that is closest to the start of the perforation line 60b. This increase in material in width 82 eliminates or at least minimizes the possibility of inadvertent rupturing of the first aperture 46b' during the start of the tearing of the tear strip 58b**.

As shown on one side of the carrier 20b, the start of the perforation line 60b is aligned with the remainder of the perforation line 60b such that the entire perforation line 60b is linear. Alternatively, as shown on the opposite side of the carrier 20b, the starting portion 85 of the perforation line 60b which is adjacent to the first aperture 46b' may be angled approximately five degrees outwardly toward the outer margin of the carrier 20b relative to the remainder of the perforation line 60b which is linear. As illustrated, the starting portion 85 of the perforation line 60b is a series of spaced slits, however, it is to be understood that the starting portion 85 of the line 60b may be a series of spaced dots like that of the remainder of the perforation line 60b. The angled starting portion 85 of the perforation line 60b merges with the remainder of the perforation line 60b at point 87 which is prior to the point 83 of the aperture 46b'. That is, point 87 is closer to the end 62b of the carrier 20b than point 83. It is to be understood that the start of the perforation line 60b can be aligned with the remainder of the perforation line 60b on both side of the carrier 20b, if desired, or, alternatively, the angled starting portion 85 may be provided on both sides of the carrier 20b.

When each strip 58b is torn along its perforation line 60b, the slits 76 at the end of the perforation line 60b direct the tearing forces inwardly into the aperture 46b" to free the container held within the last aperture 46b". The end of the tear strip 58b remains attached to the carrier device 20b at point 64b to the remainder of the outer margin 38b of the carrier 20b and does not separate into a distinct, discardable device from the remainder of the carrier device 20b. When the tear strip 58b with the handle portion 70 integrally formed therewith is torn, the handle portion 70 separates with the tear strip 58b.

Once each strip 58b is separated from its associated first portion 56b, a very narrow, continuous web of material, which is formed from the first portion 56b, remains adjacent to the apertures 46 with the exception of the last aperture 46b" since the slits 76 direct the tearing forces inwardly to free the container held therewithin. The remainder of the web 56b is not torn or ruptured by the tearing of the strip 58b which retains the remainder of the containers in the package array so as to not separate from each other. The tearing action of the strip 58b from the remaining portion of the carrier device 20b may form a jagged edge along the length of the web 56b.

To release the remaining containers from the carrier device 20b, the narrow web 56b is selectively ruptured. Since the carrier device 20b is positioned along the side walls 24 of each of the bottles, the web 56b may be selectively and easily ruptured through a leveraging of the bottles against adjacent bottles to break the remaining narrow web 56b which holds the bottles together in the package array.

As shown in the drawings, each tear strip 58, 58a, 58b may include an enlarged portion 66, 66a, 66b at its starting end with an aperture 68, 68a, 68b therein. To tear the strip 58, 58a, 58b, the consumer grasps the enlarged portion 66, 66a, 66b of the strip 58, 58a, 58b and may place a finger through the aperture 68, 68a, 68b in the enlarged portion 66, 66a, 66a to facilitate gripping of the tear strip 58, 58a, 58b so that the strip 58, 58a, 58b can be easily torn.

The carrier device 20, 20a, 20b of the present invention presents several other advantages. For example, the carrier device 20, 20a, 20b are sturdy while allowing a consumer to easily and quickly remove the containers 22. The carriers device 20, 20a, 20b of the present invention can be manufactured at a low cost.

While preferred embodiments of the present invention are shown and described, it is envisioned that those skilled in the art may devise various modifications of the present invention without departing from the spirit and scope of the appended claims.

The invention claimed is:

1. A carrier for carrying a plurality of containers comprising: container engaging portions, each container engaging portion comprising bands disposed in a row and defining apertures therein, each said aperture for holding a single container therein to form a package, adjacent bands in said row being joined to each other, said bands on one of said container engaging portions having an outer margin portion extending along said row, said outer margin portion having a first portion proximate to said apertures, a second portion and separating means between said first and second portions and having a starting point at one end of said row for selectively separating the second portion from the first portion; and a handle portion connected to the second portion of the outer margin portion.

2. A carrier as defined in claim 1, wherein said handle portion is integrally formed with said second portion.

3. A carrier as defined in claim 1, wherein said handle portion includes a gripping portion and connecting portions, said connecting portions being integrally formed with said second portion thereby defining junctures between said connecting portions and said second portion, said gripping portion connecting said connecting portions together, said separating means having a portion which is adjacent to each of said junctures and which is more difficult to separate than the remainder of said separating means.

4. A carrier as defined in claim 3, wherein said separating means is a perforation line, said perforation line comprising a series of dots, said dots being spaced apart from each other, said dots in said perforation line adjacent to said junctures defining a region, said dots in said region being spaced apart a distance from each other which is greater than the distance between the remaining dots in said perforation line so that said first portion is more difficult to separate from said second portion in said region.

5. A carrier as defined in claim 4, wherein said first portion of said outer margin has a width which is greater than the distance between any two adjacent dots in said perforation line.

6. A carrier as defined in claim 4, wherein said perforation line ends in a region within the perimeter of the carrier such that when said second portion is separated from said first portion of the outer margin, said second portion remains attached to the remainder of the container engaging portion.

7. A carrier as defined in claim 6, wherein said perforation line starts at one end of the container engaging portion and further including at least one slit in said container engaging portion between the end of said perforation line and the aperture which is farthest away from the start of the perforation line such that when said first portion is torn, the tearing forces are directed inwardly into said farthest aperture.

8. A carrier as defined in claim 1, wherein said bands on another one of said container engaging portions defines an outer margin portion extending along said row which has a first portion proximate to said apertures, a second portion and separating means between said first and second portions and having a starting point at one end of said row for selectively separating the second portion from the first portion.

9. A carrier for carrying a plurality of containers comprising: container engaging portions, each container engaging portion comprising bands disposed in a row and defining apertures therein, each said aperture for holding a single container therein to form a package, adjacent bands in said row being joined to each other, said bands having an outer margin portion extending along said row, said outer margin portion on at least one of said container engaging portions having a first portion, a second portion and separating means between said first and second portions and having a starting point at one end of said row for selectively separating the second portion from the first portion; the separating means including a perforation line starting at one end of said container engaging portion and further including at least one slit between the end of said perforation line and the aperture which is farthest away from the start of the perforation line such that when each said first portion is torn, the tearing forces are directed inwardly into said farthest aperture.

10. A carrier as defined in claim 9, further including a handle portion attached to the second portion of at least one of said container engaging portions for carrying the package.

11. A carrier as defined in claim 9, wherein said at least one slit includes a plurality of slits extending parallel to the perforation line.

12. A carrier as defined in claim 11, wherein said perforation line comprises a series of dots, said dots being spaced apart from each other predetermined distances.

13. A carrier as defined in claim 12, wherein said perforation line ends in a region within the perimeter of the carrier such that when each said second portion is separated from said first portion of the outer margin, each said second portion remains attached to the remainder of the respective container engaging portion.

14. A carrier as defined in claim 9, wherein said at least one slit is a slit angularly disposed between the end of the perforation line and the farthest aperture.

15. A carrier for carrying a plurality of containers comprising: container engaging portions, each container engaging portion comprising bands disposed in a row and defining apertures therein, each said aperture for holding a single container therein to form a package, adjacent bands in said row being joined to each other, said bands having an outer margin portion extending along said row, said outer margin portion on at least one of said container engaging portions having a first portion, a second portion and separating means between said first and second portions and having a starting point at one end of said row for selectively separating the second portion from the first portion; and a handle portion connected to the second portion of the outer margin portion, said handle portion includes a gripping portion and connecting portions, said connecting portions being integrally formed with said second portion thereby defining junctures between said connecting portions and said second portion, said gripping portion connecting said connecting portions together, said separating means having a portion which is adjacent to each of said junctures and which is more difficult to separate than the remainder of said separating means.

16. A carrier as defined in claim 15, wherein said separating means is a perforation line, said perforation line comprising a series of dots, said dots being spaced apart from each other predetermined distances, said dots in said perforation line adjacent to said junctures defining a region, said dots in said region being spaced apart a distance which is greater than the distance between the remaining dots in said perforation line so that said first portion is more difficult to separate from said second portion in said region.

17. A carrier as defined in claim 16, wherein said first portion of said outer margin has a width which is greater than the distance between any two adjacent dots in said perforation line.

18. A carrier as defined in claim 16, wherein said perforation line ends in a region within the perimeter of the carrier such that when said second portion is separated from said first portion of the outer margin, said second portion remains attached to the remainder of the container engaging portion.

19. A carrier as defined in claim 18, wherein said perforation line starts at one end of the container engaging portion and further including at least one slit in said container engaging portion between the end of said perforation line and the aperture which is farthest away from the start of the perforation line such that when said first portion is torn, the tearing forces are directed inwardly into said farthest aperture.

* * * * *